US007207249B1

(12) United States Patent
Smith

(10) Patent No.: US 7,207,249 B1
(45) Date of Patent: Apr. 24, 2007

(54) LINEAL OPTIMIZATION GANG/EDGER FOR CUTTING CANTS AND FLITCHES

(75) Inventor: Greg F. Smith, Portland, OR (US)

(73) Assignee: Timber Machine Technology, Inc., Tualatin, OR (US)

( * ) Notice: Subject to any disclaimer, the term of this patent is extended or adjusted under 35 U.S.C. 154(b) by 0 days.

(21) Appl. No.: 11/464,785

(22) Filed: Aug. 15, 2006

Related U.S. Application Data

(62) Division of application No. 10/447,194, filed on May 27, 2003, now Pat. No. 7,108,030.

(51) Int. Cl.
*B27B 1/00* (2006.01)
*B26B 5/04* (2006.01)

(52) U.S. Cl. ..... 83/13; 83/76.8; 83/368; 83/371; 83/425.4; 144/357; 144/358; 144/378

(58) Field of Classification Search ..... 83/13, 83/811, 75.5, 76.8, 66.9, 367, 368, 364, 371, 83/426, 425.2, 433, 789, 810, 812, 425.3, 83/425.4; 144/357, 39, 358, 356, 378
See application file for complete search history.

(56) References Cited

U.S. PATENT DOCUMENTS

| | | | | |
|---|---|---|---|---|
| 3,806,253 | A | 4/1974 | Denton | |
| 3,903,771 | A * | 9/1975 | Fritz et al. | 83/102.1 |
| 4,462,443 | A | 7/1984 | Allen | |
| 4,947,909 | A * | 8/1990 | Stroud | 144/357 |
| 5,232,030 | A | 8/1993 | Knerr et al. | |
| 5,394,342 | A | 2/1995 | Poon | |
| 5,722,474 | A * | 3/1998 | Raybon et al. | 144/357 |
| 5,870,936 | A | 2/1999 | McGehee | |
| 5,946,995 | A | 9/1999 | Michell et al. | |
| 6,135,176 | A * | 10/2000 | Smith | 144/39 |
| 6,178,858 | B1 * | 1/2001 | Knerr et al. | 83/76.8 |
| 6,463,402 | B1 * | 10/2002 | Bennett et al. | 703/2 |
| 6,612,216 | B2 * | 9/2003 | McGehee et al. | 83/425.4 |
| 6,755,102 | B2 | 6/2004 | Buchanan et al. | |
| 6,929,043 | B2 | 8/2005 | Woodford | |
| 7,108,030 | B1 * | 9/2006 | Smith | 144/357 |
| 2002/0152861 | A1 * | 10/2002 | Conry | 83/56 |
| 2003/0019545 | A1 * | 1/2003 | Woodford et al. | 144/357 |

* cited by examiner

*Primary Examiner*—Boyer D. Ashley
*Assistant Examiner*—Ghassem Alie
(74) *Attorney, Agent, or Firm*—Marger Johnson & McCollom, P.C.

(57) ABSTRACT

A combination gang saw and edger system cuts both cants and flitches into boards. Cants and flitches are fed singly, lengthwise into the system on an infeed conveyor. On the conveyor, the cant or flitch is scanned to produce a lengthwise cross-sectional profile. An optimizer determines whether the profile is for a cant or flitch and determines how the piece will be cut. A controller responsive to the optimizer directs the positioning of a first and second set of saws on a pivotably mounted saw arbor to cut either a cant or flitch, respectively. The boards cut from the cant or flitch are fed outfed from the system. The system can cut cants with longitudinal curvature and can cut cants or flitches that are placed at an angle to the length of the infeed conveyor.

5 Claims, 11 Drawing Sheets

LINEAL OPTIMIZATION GANG/EDGER FOR CUTTING CANTS AND FLITCHES

RELATED APPLICATION DATA

This application is a division of application U.S. Ser. No. 10/447,194, filed May 27, 2003, now U.S. Pat. No. 7,108,030, incorporated by reference herein.

BACKGROUND OF THE INVENTION

The invention pertains to sawmill machinery and more particularly to sawmill machinery for scanning and cutting boards from cants and flitches.

Most saw mills utilize dedicated gang saws to cut cants and dedicated edgers to cut flitches to achieve high volume production rates. Dimension lumber mills need to produce at high rates to maintain profitability because of the relatively low value softwood; in other words: throughput is most important. However, grade mills processing higher valued hardwoods such as cherry and maple can maintain profitability at much lower production rates because those hardwoods can be worth as much as 14 times that of an equivalent amount of softwood such as Douglas fir. The higher value of hardwoods makes yield of useful boardage most important. Achieving this goal can be difficult because hardwood logs may be very irregularly shaped.

For dimension mills, the critical cost factor focuses on maintaining high production rates and separate dedicated processing machines helps those mills to maintain those high production rates. But, because smaller hardwood mills typically process at lower rates, a smaller hardwood mill's critical costs are in the capital equipment. Currently, a small grade mill suffers the costs of buying two separate optimized systems to gang saw cants into boards and to edge flitches into boards, each including separate scanning and optimizer systems. This is not cost effective.

Therefore, it would help small hardwood mills to buy only one piece of equipment that performs both tasks of gang sawing cants and edging flitches rather than buying two separate sawing machines.

SUMMARY OF THE INVENTION

It is an object of this invention to provide a combination gang saw and edger system to process both cants and flitches into boards. The system comprises an infeed conveyor traveling in an infeed direction that carries cants or flitches lengthwise one at a time. Scanners scan the cant or flitch on the infeed conveyor to image a lengthwise cross-sectional profile of the cant or flitch. An optimizer responds to the profile and determines whether the profile is for a cant or a flitch and determines one or more ways to cut the cant or flitch. The system selectably cuts the cant or flitch lengthwise into boards responsive to the optimizer. An outfeed conveyor receives the processed boards.

Another aspect of the invention is a machine center for use in sawing cants and flitches into boards. The machine center comprises a frame with an infeed module for receiving lengthwise a cant or flitch in an infeed direction and can include an outfeed module for outfeeding lengthwise the boards cut from the cant or flitch. A means for retaining the cant or flitch is provided to retain the cant or flitch in an infeed position. A saw arbor is positioned in the machine center transverse to the infeed direction. A first set of saws for cutting cants comprising a cluster of a plurality of circular saws is mounted on the saw arbor. The first cluster of saws can have a predeterminable set of spacings between the plurality of saws in the cluster. And, a second set of at least two circular saws is mounted on the saw arbor for cutting flitches.

Another aspect of the invention can skew the saw arbor angularly in a plane parallel to the infeed direction. Further, the invention can position and variably slew the first set of saws together along the length of the saw arbor and can position and variably slew each of the second set of saws along the length of the saw arbor.

The invention also includes a method combining gang sawing cants and edging flitches into one machine. The method includes loading a cant or flitch lengthwise on an infeed conveyor traveling in an infeed direction where the cant or flitch is scanned to produce a lengthwise cross-sectional profile and then determining whether the profile is for a cant or flitch. The method also provides for positioning a saw arbor transverse to the infeed direction. Responsive to determining that the profile is for a cant, the method provides for cutting the cant into boards by feeding the cant lengthwise in an infeed direction across a first set of saws mounted on the saw arbor. Responsive to determining that the profile is for a flitch, the method provides for cutting the flitch into boards by feeding the flitch lengthwise in an infeed direction across a second set of saws mounted on the saw arbor.

Another aspect of the method includes responding to the determining step by selecting one of the first and second sets of saws and positioning the selected set of saws across the infeed direction.

The method can be used to cut a cant by dynamically skewing the saw arbor in a plane parallel to the infeed direction and dynamically stewing the first set of saws along the length of the saw arbor across the path of the infeed direction to cut boards from a cant with lengthwise curvature or from a cant positioned at an angle to the infeed direction.

The method can be used to cut a flitch by setting a skew angle of the saw arbor in a plane parallel to the infeed direction and dynamically stewing each of the selected second sets of saws along the length of the saw arbor across the path of the infeed direction to boards from a flitch that is positioned at an angle to the infeed direction.

The foregoing and other objects, features, and advantages of the invention will become apparent from the following detailed description of a preferred embodiment which proceeds with reference to the accompanying drawings.

DETAILED DESCRIPTION

Figure 1:
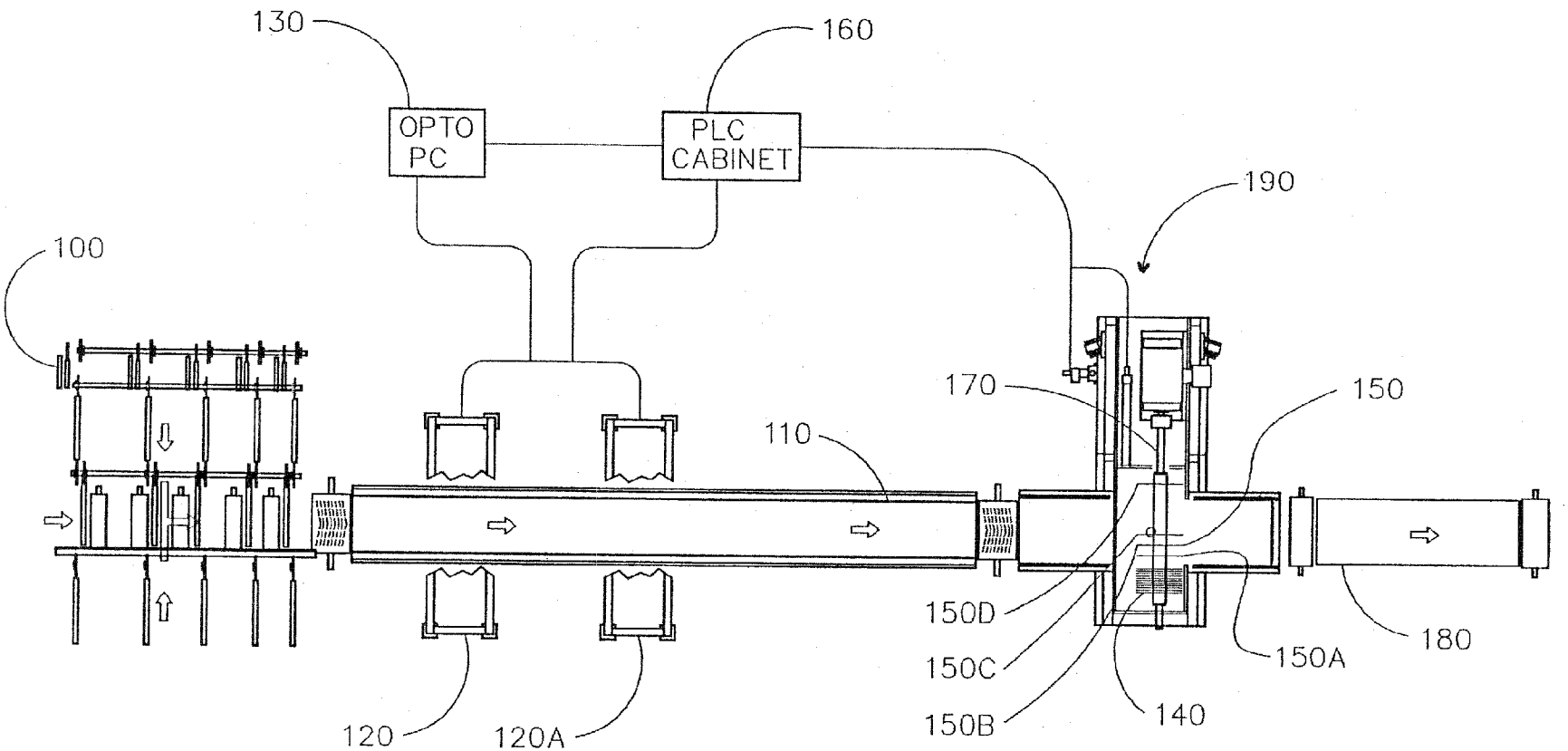
FIG. 1 is a top plan view of the preferred embodiment of a combination gang saw and edger system for processing cants and flitches into boards according to the invention.
Figure 2:
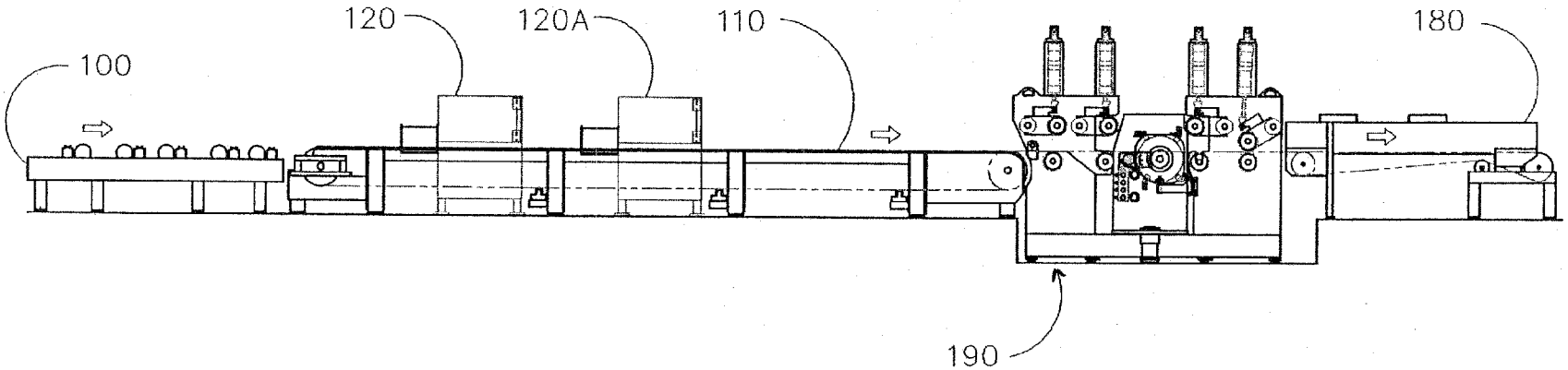
FIG. 2 is a side elevation view of the combination gang saw and edger system of FIG. 1.

FIGS. 1 and 2 collectively show the overall combination gang saw and edger system. FIG. 1 shows a top plan view of the gang saw and edger system and FIG. 2 shows a side elevation view of the gang saw and edger system. Loader 100 loads cants or flitches onto the infeed conveyor 110 traveling in an infeed direction. The loader is preferably a scan rollcase arranged so that cants and flitches may be loaded onto the infeed conveyor 110 from either side of the infeed conveyor or from the end of the infeed conveyor. The infeed conveyor 110 is preferably a precision scan transfer belt. The infeed conveyor 110 carries either a cant or a flitch, one at a time, lengthwise past one or two scan plane scanners 120 and 120A which scan the cant or flitch to measure the lengthwise cross-sectional profile of the cant or flitch. Optimizer 130 calculates the lengthwise cross-sectional profile of the cant or flitch from data received from the scan plane scanners 120 and 120A. The optimizer 130 determines if the piece is a cant or a flitch and calculates one or more ways to cut the cant or flitch. The optimizer 130 is preferably a personal computer running cutting optimizer software. For cutting cants, the infeed conveyor 110 feeds a cant across a first positionable set of saws 140. For cutting flitches, the infeed conveyor 110 feeds a flitch across a second positionable set of saws 150.

A controller 160 selects one of the first or second set of saws responsive to the determination by the optimizer 130. The first and second sets of saws, 140 and 150, are mounted on a common saw arbor 170 that is positioned transverse to the infeed direction of the infeed conveyor 110. The saws 140 and 150, on saw arbor 170, are preferably mounted in a machine center 190, further described below.

Responsive to a determination by the optimizer 130 that a profile is a cant, the controller 160 dynamically skews the saw arbor 170 angularly relative to the infeed direction of the infeed conveyor 110 and dynamically slews the first set of saws 140 along the length of the saw arbor 170 to cut a cant with lengthwise curvature and a cant lengthwise positioned at angle to the infeed direction of the infeed conveyor 110.

Responsive to a determination by the optimizer 130 that a profile is a flitch, the controller 160 sets the skew angle of the saw arbor 170 relative to the infeed direction of the infeed conveyor 110, positions two or more of the saws 150A, 150B, 150C and 150D across the path of the infeed direction of the infeed conveyor 110, and dynamically slews the saws 150A, 150B, 150C and 150D across the path of the infeed direction of the infeed conveyor 110 to cut a flitch positioned at an angle to the infeed direction of the infeed conveyor 110. The boards cut from the cants and flitches by the machine center 190 are received by an outfeed conveyor 180.

FIG. 1 shows two scan plane scanners 120 and 120A for measuring the lengthwise cross-sectional profile of the cant or flitch. Alternatively, one scan plane scanner can be utilized to scan the cant or flitch. A single scan plane scanner requires that the infeed conveyor 110 be long enough for the cant or flitch to completely pass by the scanner before entering the machine center for cutting to allow for a complete measurement of the cant or flitch. Two or, alternatively, three or more scanners allow for a decreased length of the infeed conveyor by measuring the cant or flitch in subsections. The scanning means is not restricted to scan plane scanners and can be accomplished through use of other types of linear scanners as commonly used in the industry.

FIG. 2 shows a side elevation view of the combination gang saw and edger system. Loader 100 is positioned at the end of the infeed conveyor 110 for loading cants or flitches onto the infeed conveyor 110 lengthwise. The infeed conveyor 100 feeds the cants or flitches lengthwise into the machine center 190. Outfeed conveyor or take-away belt 180 receives the cut boards from machine center 190.

Figure 3:
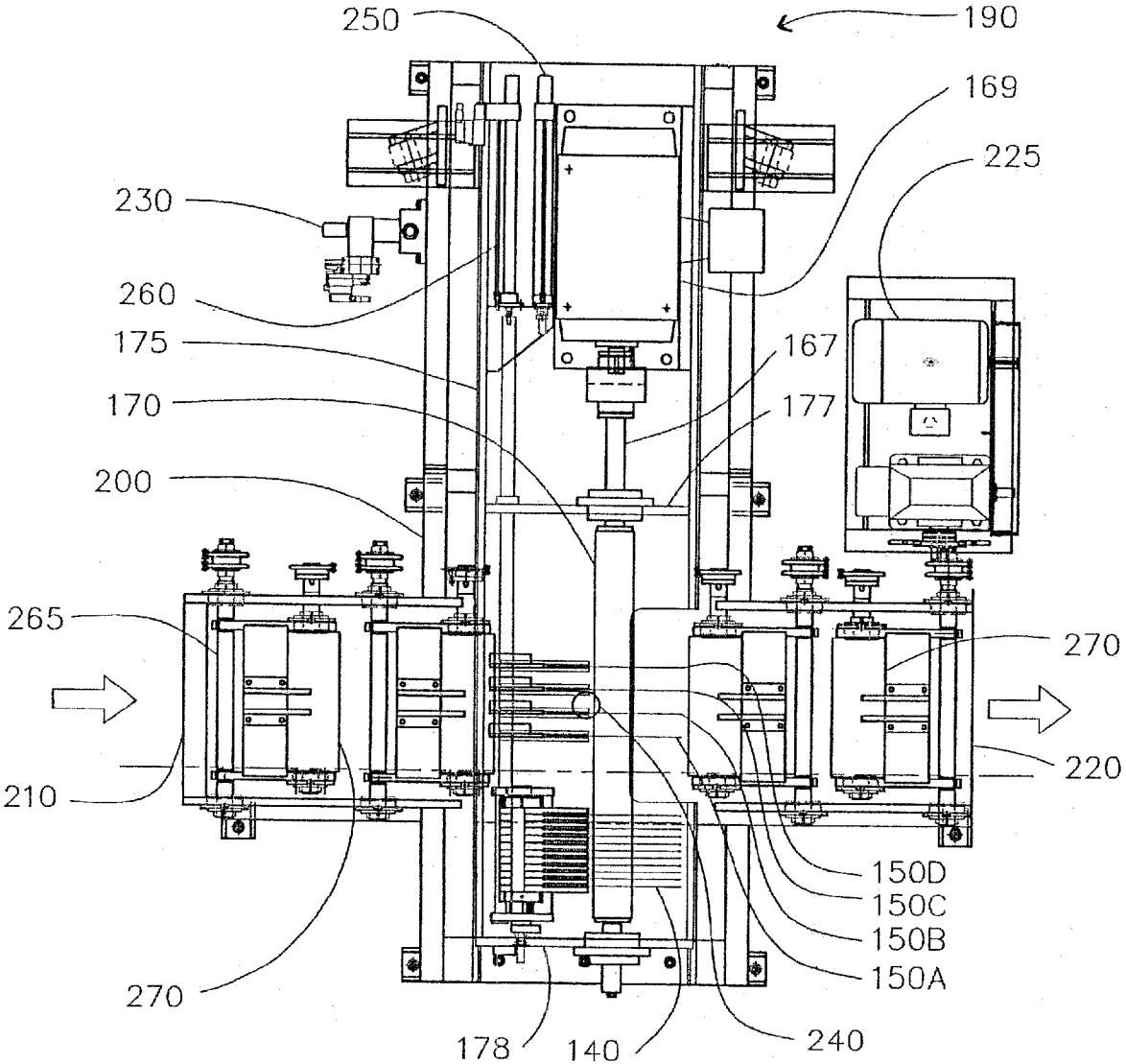
FIG. 3 is a detailed top view of the machine center of the combination gang saw and edger system of FIG. 1.

FIG. 3 shows a detailed top view of the machine center 190. The machine center has a frame 200 with infeed module 210 for receiving cants or flitches one at a time lengthwise into the machine center for cutting and an outfeed module 220 for outfeeding the cut boards from the machine center. The infeed module 210 and the outfeed module 220 utilize press roll 265 and feed rolls 270 for retaining position of a work piece and feeding the work piece supported by bed rolls 272 through the machine center 190, respectively. Feed works drive motor 225 drives the press rolls 265 and feed rolls 270 in the infeed module 210 and outfeed module 220. The saw arbor 170 is mounted in saw box 175 such that the saw arbor 170 is positioned transversely to the lengthwise infeed direction of the infeed conveyor 110. The saw arbor 170 is mounted between an intermediate web 177 and an end web 178 of the saw box 175. A drive shaft 167 extends from the saw arbor drive motor 169 to power the saw arbor 170. The first set of saws 140, for sawing cants, comprising a cluster or plurality of circular saws, is positioned on the saw arbor 170. This first cluster of saws 140 preferably comprises twelve saws. The spacing of the saws in the first set of saws 140 is set prior to operation of the machine center 190 for producing boards of a thickness defined by that spacing. A second set of saws 150 comprising at least two and preferably three or four circular saws, 150A, 150B, 150C and 150D, are selectably positioned on the saw arbor 170. A saw arbor actuator 230 can skew the saw arbor 170 angularly about the center pivot 240 in a plane parallel to the infeed direction of the infeed conveyor 110.

Figure 4:
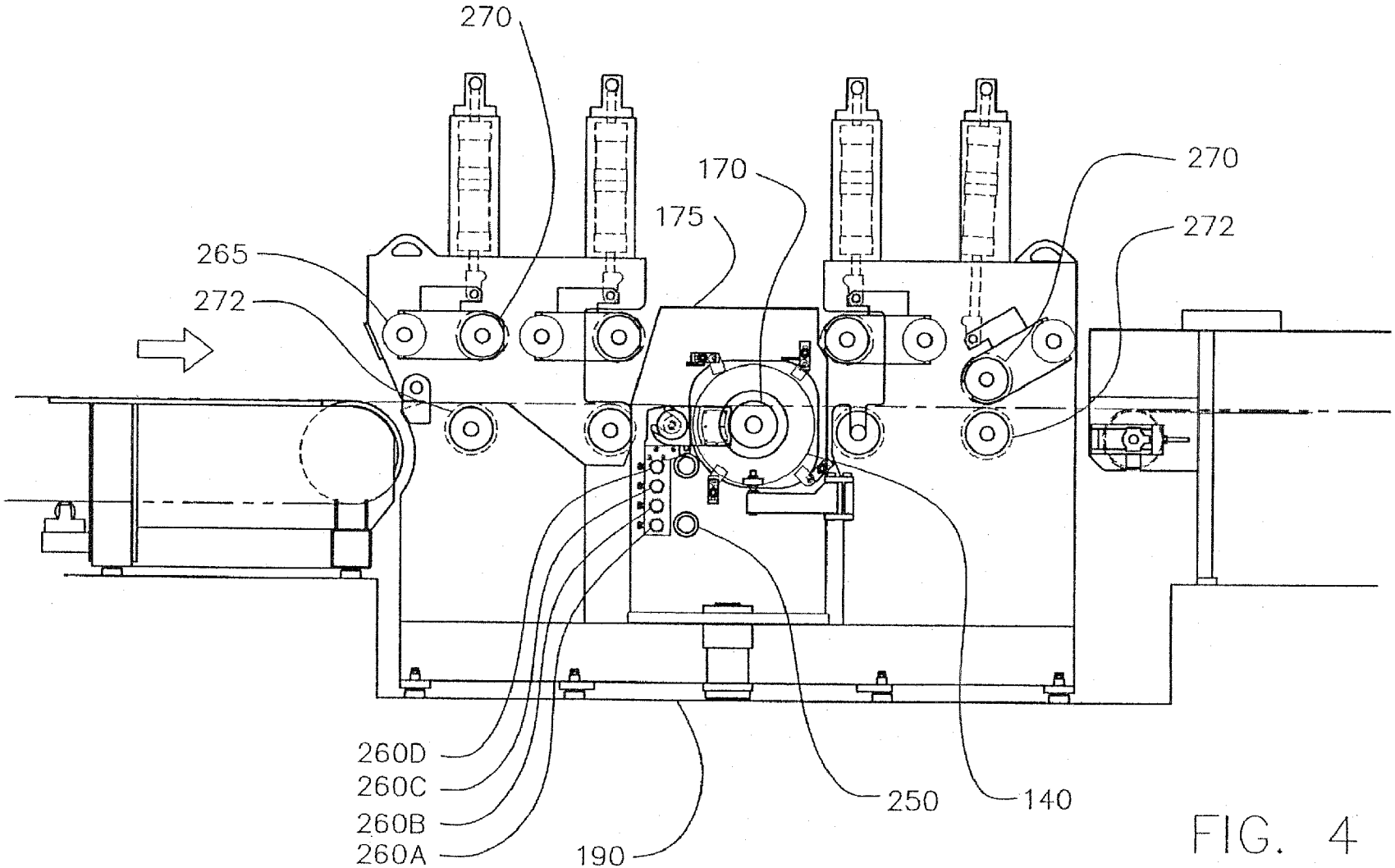
FIG. 4 is a detailed side view of the machine center of the combination gang saw and edger system of FIG. 1.

FIG. 4 shows a detailed side elevation view of the machine center 190. A first saw actuator 250 slews the first cluster of saws 140 along the length of the saw arbor 170 mounted in saw box 175 to position the cluster 140 for cutting cants. Second saw actuators 260A, 260B, 260C and 260D slew each of the saws 150A, 150B, 150C and 150D of the second set of saws 150 along the length of the saw arbor 170 to position those saws for cutting flitches. It is desirable to maintain the cant or flitch in an infeed position for cutting by retaining the cant or flitch laterally and angularly in the position it was scanned relative to the infeed direction. There are a number of ways to retain the cant or flitch. The preferred embodiment uses press rolls 265 to retain a cant or flitch in an infeed direction. Feed rolls 270 infeed the cant or flitch across the saws and also outfeed the cut boards from the machine center 190.

METHOD AND OPERATION OF THE COMBINATION

Figure 9:
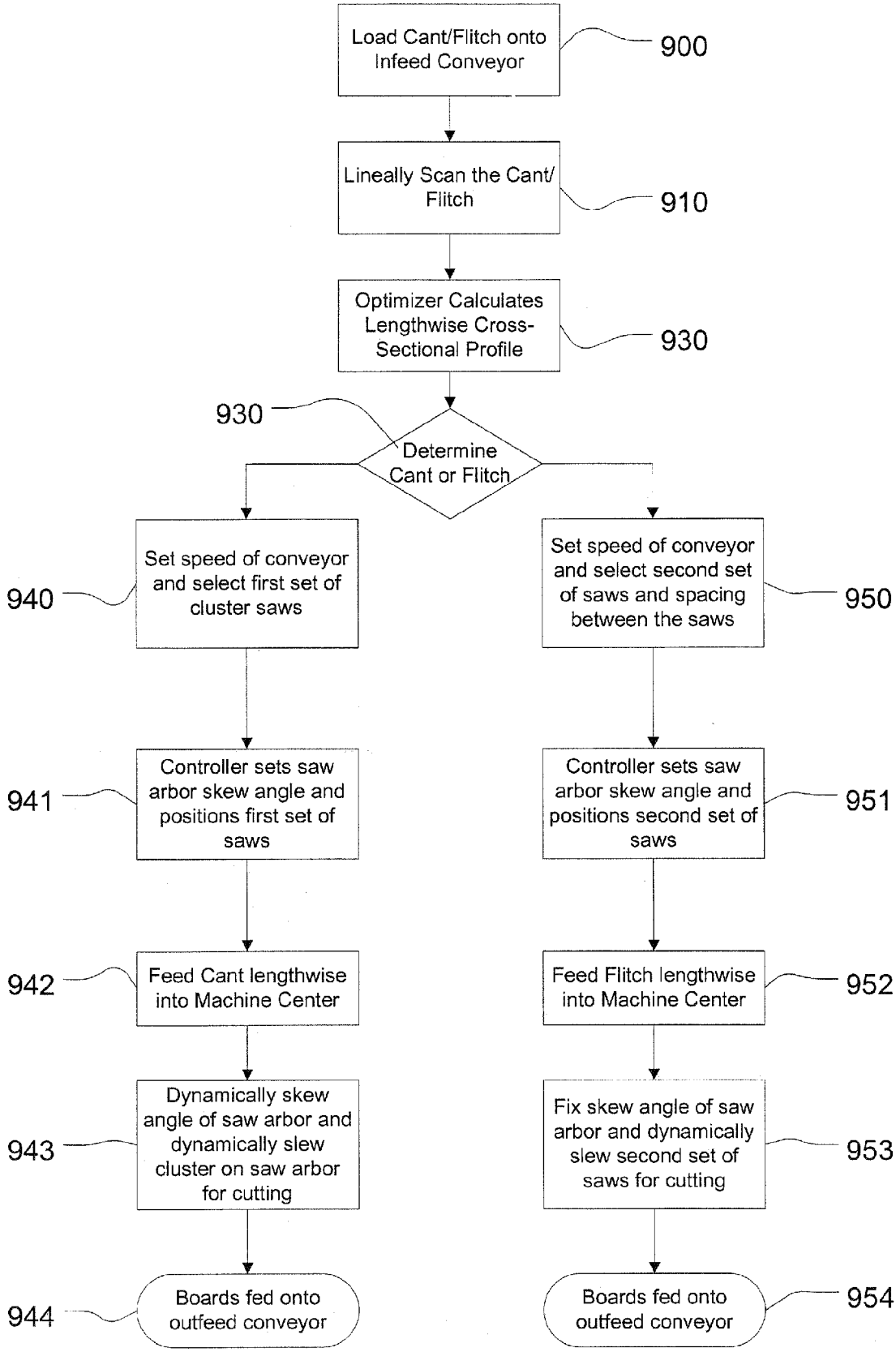
FIG. 9 is a flow chart describing the method of cutting cants and flitches using the combination gang saw and edger system of FIG. 1.

FIG. 9 is a flow chart of the loading, scanning, optimizing and cutting processes used in operating the apparatus of FIGS. 1–4. Step 900 loads a cant or flitch onto an infeed conveyor. Step 910 scans the cant or flitch. In Step 920, an optimizer calculates the lengthwise cross-sectional profile of the cant or flitch and then, in Step 930, the optimizer determines whether the profile is a cant or flitch.

If the optimizer determines in Step 930 from the profile that a given work piece is a cant, the process follows the left branch of the flow chart. In Step 940, the speed of the infeed conveyor is adjusted and the first set of saws is selected. The first set of saws is mounted on a saw arbor positioned transverse to the infeed direction of the infeed conveyor. In Step 941, a controller positions the first set of saws across the infeed path of the infeed conveyor and sets a saw arbor skew angle. In Step 942, the cant is fed lengthwise into the machine center. In Step 943, the cant is cut into boards of predetermined thickness when the controller dynamically skews the angle of the saw arbor and dynamically slews the first set of saws along the length of the saw arbor. Step 944 completes the process of cutting the cant by feeding the boards cut from the cant onto an outfeed conveyor.

If the optimizer determines in Step 930 from the profile that a given work piece is a flitch, the process follows the right branch of the flowchart. In Step 950, the speed of the infeed conveyor is adjusted and the second set of saws is selected. The second set of saws is mounted on the same saw arbor that is positioned transverse to the infeed direction of the infeed conveyor. In Step 951, a controller positions the second set of saws across the infeed path of the infeed conveyor and sets a saw arbor skew angle. In Step 952, the flitch is fed lengthwise into the machine center. In Step 953, the flitch is cut into boards when the controller fixes the saw arbor skew angle and dynamically slews the second set of saws along the saw arbor. Step 954 completes the process of cutting the flitch by feeding the boards cut from the flitch onto an outfeed conveyor.

Steps 900–930 can be operated in parallel to the left or right branches of the lower part of the flow chart, Steps 940–944 or Steps 950–954, so that the next work piece is being fed onto the conveyor and scanned and optimized while the previous work piece is being cut.

The loading process in Step 900 can be achieved by loading the cants or flitches one at a time onto the infeed conveyor 110 from either side of the conveyor or by loading the cants or flitches one at a time lengthwise onto the infeed conveyor 110 from the end of the infeed conveyor 110.

The scanning process in Step 910 can be achieved by using one, two, or three scan plane scanners. Scanning with one scan plane scanner requires the infeed conveyor to be long enough for the cant or flitch to completely pass by the scanner before entering the machine center for cutting to allow for a complete measurement of the cant or flitch. Scanning with two or three scan plane scanners allow for a shorter infeed conveyor because the multiple scanners image subsections of the length of the cant or flitch. While more scanners increases cost of equipment, decreasing the length of the infeed conveyor is advantageous for space considerations.

Figure 5:
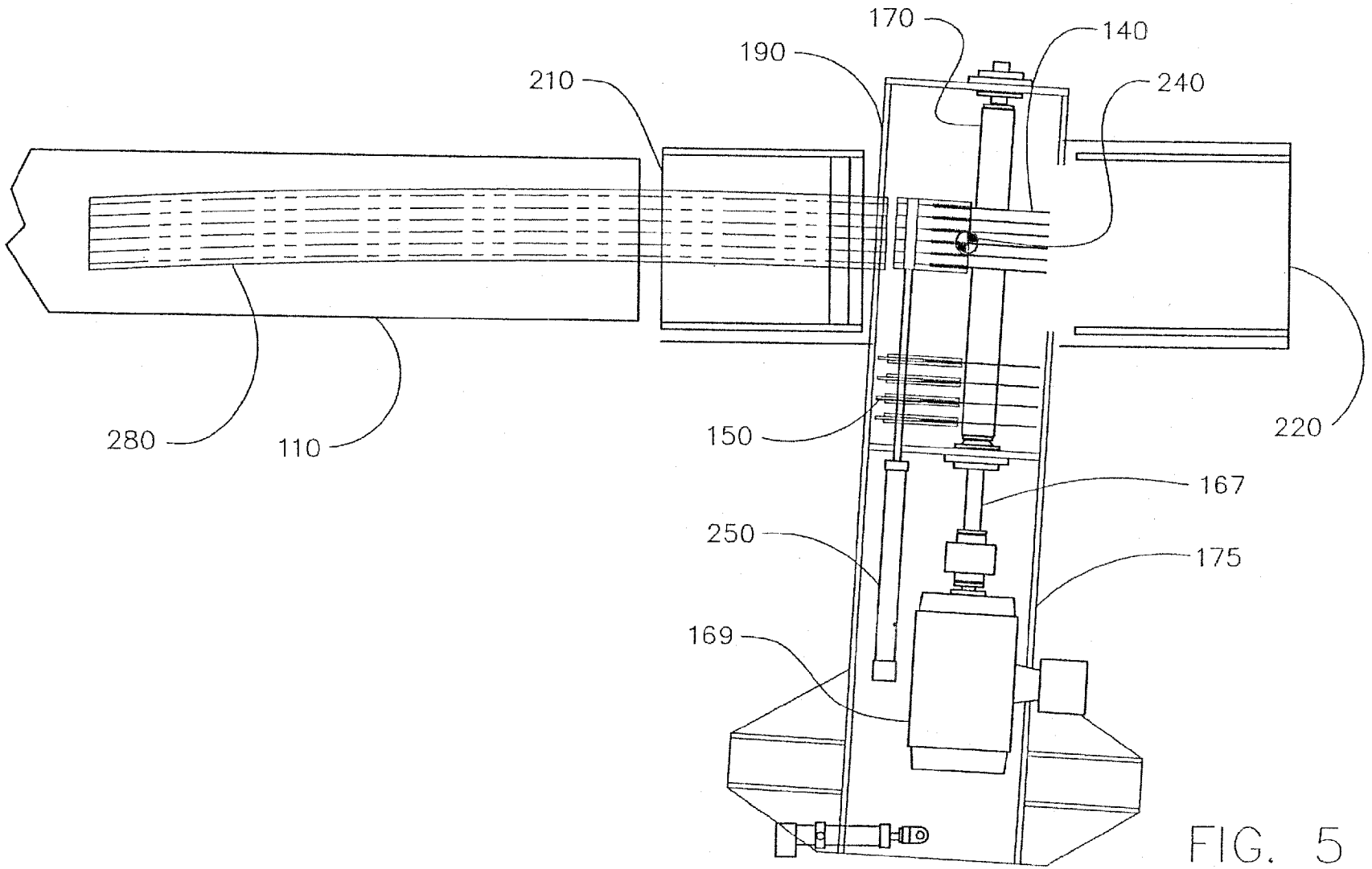
FIG. 5 is detailed top view of the combination gang saw and edger system of FIG. 1 showing a cant feeding into the machine center to be sawed by the first set of saws.

FIG. 5 is a detailed top view of the preferred embodiment of the combination gang saw and edger showing a cant 280 feeding into the machine center 190 through the infeed module 210. Press rolls in infeed module 210 retain the cant 280 in an infeed position while feed rolls in infeed module 210 feed the cant 280 across the first set of saws 140. To cut the cant 280 into boards, first saw actuator 250 slews the first set or cluster of saws 140 along the length of the saw arbor 170 to position the cluster of saws 140 across the path of the infeeding cant 280. A second set of saw actuators slew each of the second set of saws 150 along to the saw arbor 170 to position them away from the infeed direction. Saw arbor actuator 230 skews the saw arbor 170 around saw box center pivot 240 angularly to account for curvature, lengthwise, in the cant 280 and to account for a positioning of the cant 280 at an angle to the infeed direction of the infeed conveyor 110. The saw arbor drive motor 169 drives shaft 167 which drives the first set of saws 140 on saw arbor 170. Boards cut from the cant 280 are fed out of the machine center 190 by the feed rolls in outfeed module 220.

Figure 6:
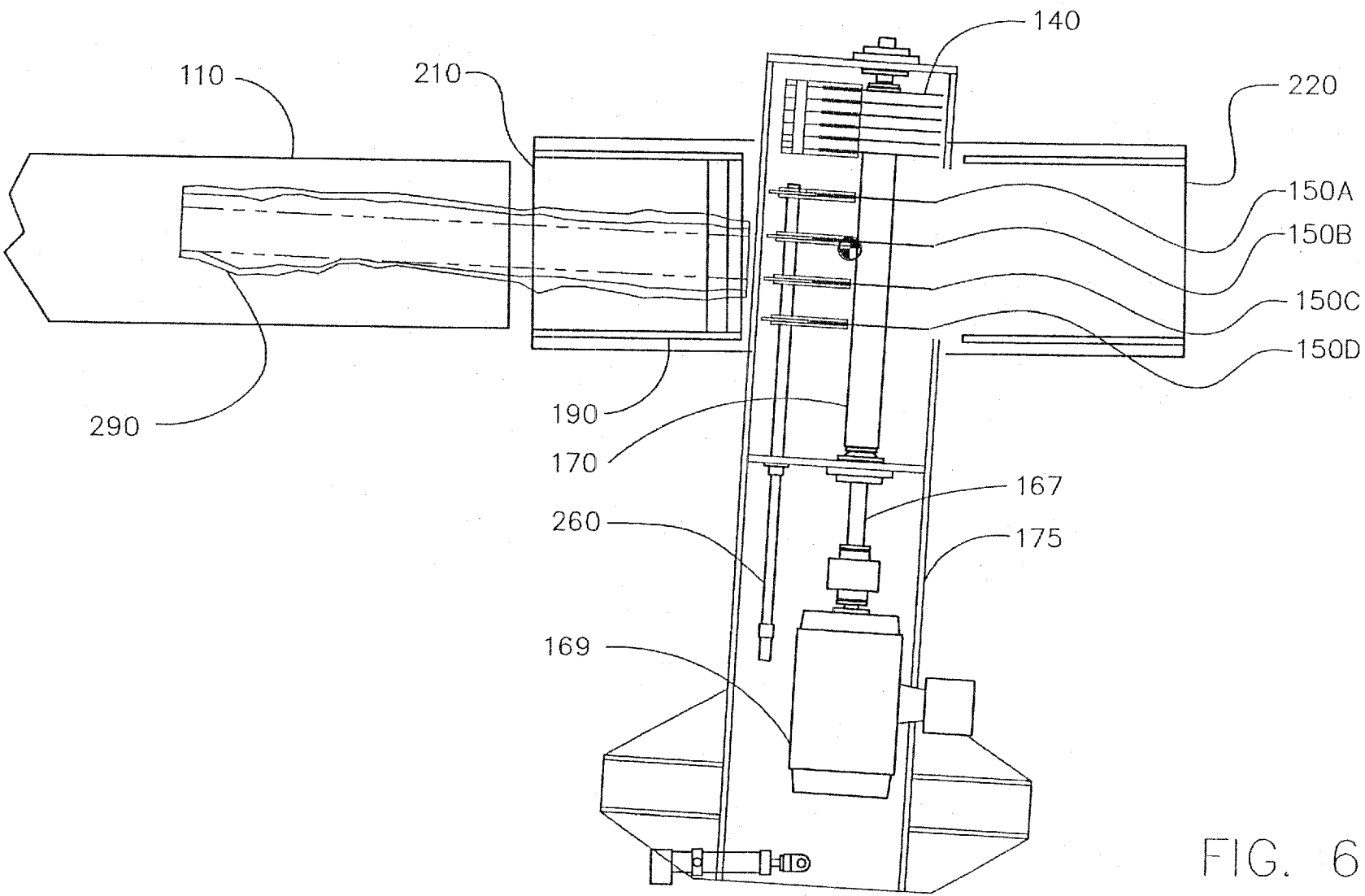
FIG. 6 is a detailed top view of the combination gang saw and edger system of FIG. 1 showing a flitch feeding into the machine center to be sawed by the second set of saws.

FIG. 6 is a detailed top view of the preferred embodiment of the combination gang saw and edger system showing a flitch 290 feeding into the machine center 190 through the infeed module 210. Press rolls in infeed module 210 retain the flitch 290 in an infeed position while feed rolls in infeed module 210 feed the flitch 290 across the second set of saws 150. To cut the flitch 290 into boards, second saw actuators 260 individually slew the second set of single select saws 150A, 150B, 150C and 150D along the length of the saw arbor to position them across the path of the infeeding flitch 290 and to position the spacing between each saw. The first saw actuator 250 slews the first set of saws 140 away from the infeed direction. Only the saws 150B and 150C required to cut the flitch 280, as directed by the optimizer 130 and controller 160, are positioned across the path of the infeeding flitch 290. Saw arbor actuator 230 sets the saw arbor 170 skew angle relative to the infeed direction of the infeed conveyor 110 to account for a positioning of flitch 290 that is at an angle to the infeed direction of the infeed conveyor 10. The saw arbor drive motor 169 drives the second set of saws 150 on saw arbor 170. Boards cut from the flitch 290 are fed out of the machine center 190 by the feed rolls in outfeed module 220.

Figure 7:
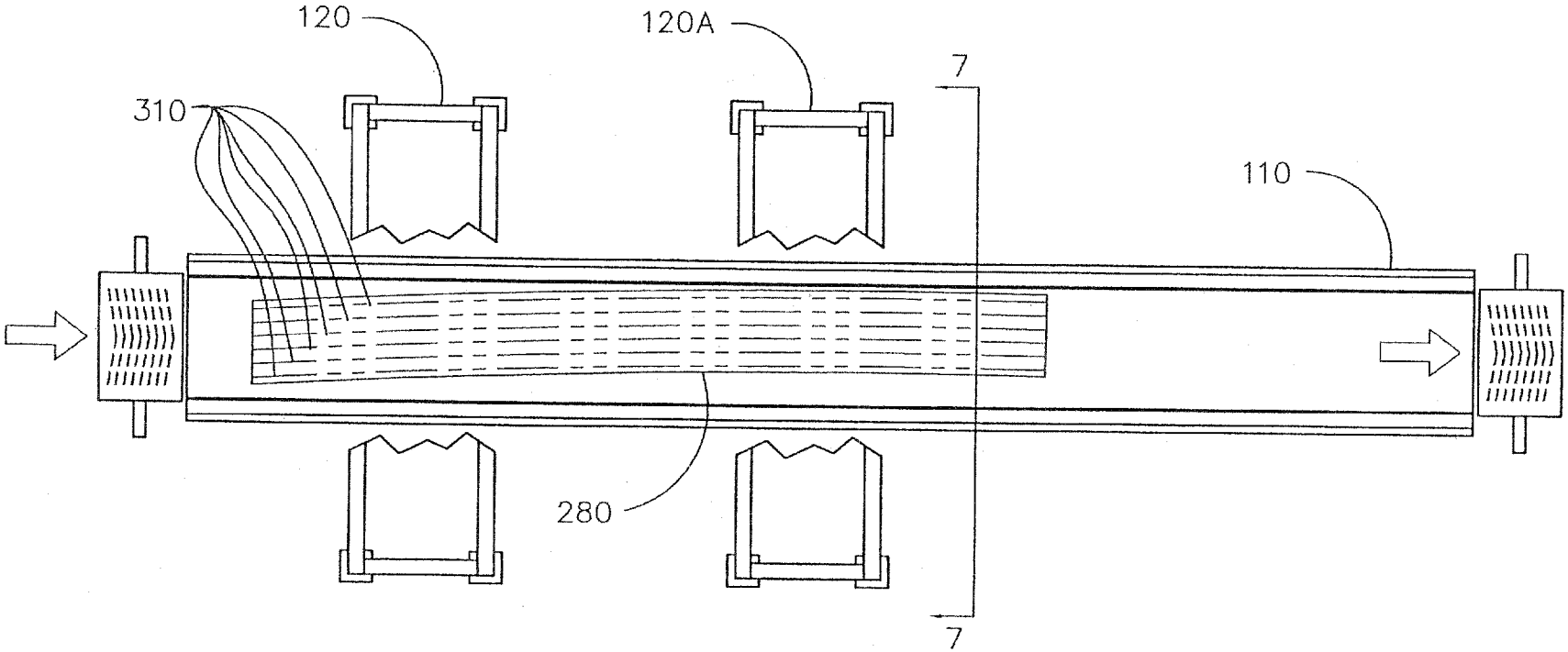
FIG. 7 is a top view of a curved cant on the in-feed conveyor of the combination gang saw and edger system of FIG. 1 showing saw lines indicating the path of the saws.
Figure 7A:
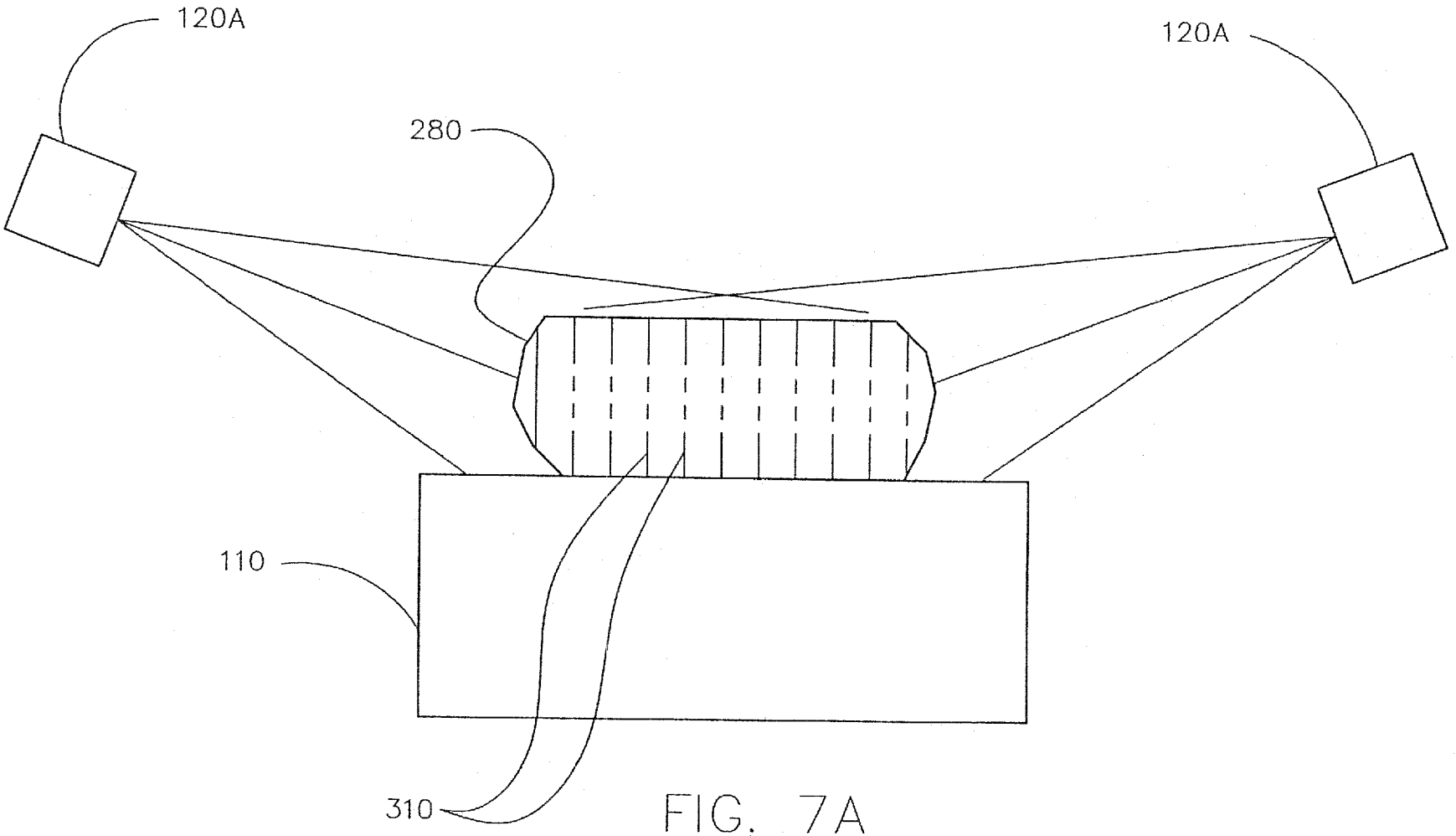
FIG. 7A is a cross-sectional view of the cant taken along line 7—7 in FIG. 7 showing the saw lines vertically in the cant indicating the path of the saws.

FIG. 7 is a top view of a curved cant 280 on the infeed conveyor 110 showing sawlines 310 that demonstrate where the cant 280 will be sawn. FIG. 7A shows a cross-sectional view taken along line 7—7 in FIG. 7 showing the cant 280 being scanned by scanner 120A and showing sawlines 310 vertically in the cant 280 indicating the path of the saws through the cant. The sawing of the curved cant 280 is achieved by simultaneously dynamically skewing the angle of the saw arbor 170 in a plane parallel to the infeed direction of the infeed conveyor 110 and dynamically slewing the first cluster of saws 140 along the length of the saw arbor 170 while feeding the cant 280 across the saw blades 140. The spacing between the blades is set prior to operation of the combination gang saw and edger system. The same method of dynamically skewing and slewing is used to cut cants that have curvature or are misaligned relative to the infeed direction.

Figure 8:
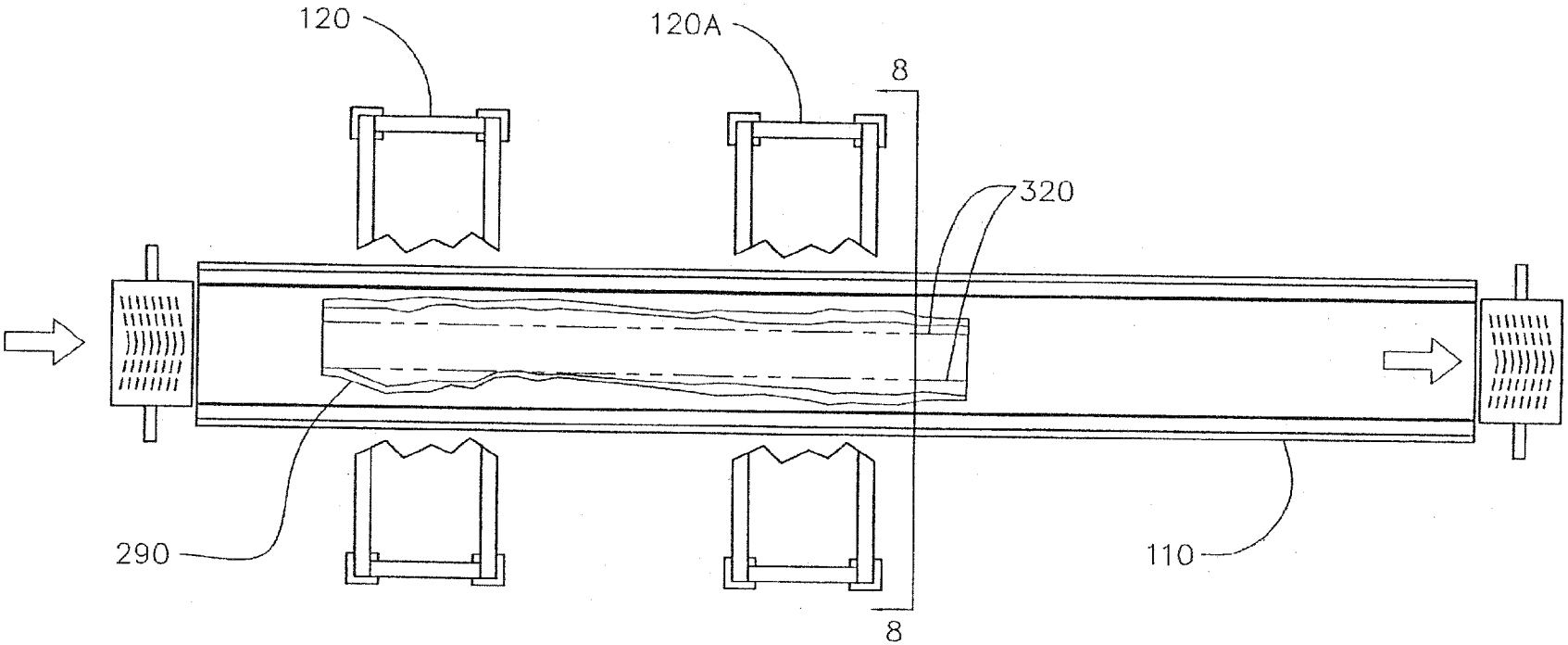
FIG. 8 is a top view of a flitch on the in-feed conveyor of the combination gang saw and edger system of FIG. 1 showing saw lines indicating the path of the saws.
Figure 8A:
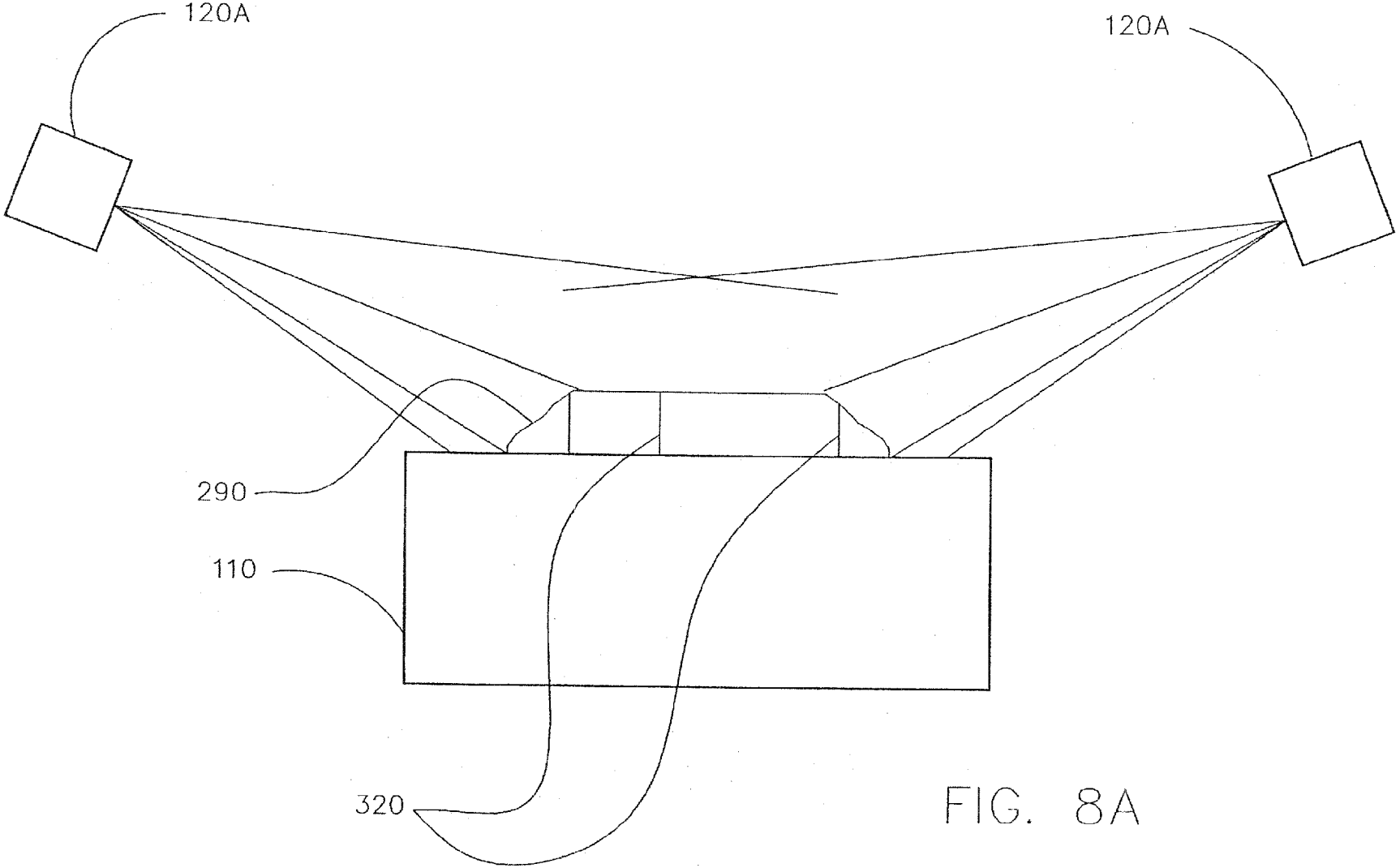
FIG. 8A is a cross-sectional view of the flitch taken along line 8—8 in FIG. 8 showing the saw lines vertically in the flitch indicating the path of the saws.

FIG. 8 is a top view of a flitch 290 on the infeed conveyor 110 showing sawlines 320 that demonstrate where the flitch 290 will be cut. The flitch 290 is typically positioned not parallel to the infeed direction of the infeed conveyor 110. FIG. 8A shows a cross-sectional view taken along line 8—8 in FIG. 8 showing flitch 290 being scanned by scan plane scanner 120A and showing sawlines 320 vertically in the flitch 290 indicating the path of the saws through the flitch. The sawing of the flitch 290 is achieved by setting the skew angle of the saw arbor 170 in a plane parallel to the infeed direction and dynamically slewing the second set of saws 150 along the length of the saw arbor 170 while feeding the flitch 290 across the saw blades. The number of blades in the second set of saws 150 is at least two but can be up to four or five. The spacing between the blades can be adjusted for each separate flitch by individual actuators 260A, 260B, 260C and 260D that slew each blade along the length of the saw arbor 170. The spacing between the blades remains constant during the cutting process.

The foregoing lineal-scan and combination edger and gang saw system is more cost-effective and simpler than the prior systems. It is particularly advantageous in small mills and hardwood mills.

Having illustrated and described the principles of the invention in a preferred embodiment thereof, it should be readily apparent to those skilled in the art that the invention can be modified in arrangement and detail without departing from such principles. All modifications coming within the spirit and scope of the accompanying claims are claimed.

The invention claimed is:

1. A method for combining gang sawing cants and edging flitches in one machine comprising:

loading the cant or flitch lengthwise onto an infeed conveyor along an infeed direction of the infeed conveyor;

positioning a saw arbor transverse to the infeed direction of the infeed conveyor;

machine scanning the cant or flitch to produce a lengthwise cross-sectional profile of the flitch or cant;

determining by a computer whether the lengthwise cross-sectional profile is for a cant or a flitch;

responsive to determining the profile is for a cant, cutting a cant into boards by feeding the cant lengthwise in the infeed direction across a first set of saws mounted on the saw arbor;

responsive to determining the profile is a flitch, cutting a flitch into boards by feeding the flitch lengthwise in the infeed direction across a second set of saws mounted on the saw arbor; and feeding the boards cut out of the cant or flitch to an outfeed conveyor.

2. The method of claim 1 including responsive to the determining step, selecting one of the first and second sets of saws and positioning the selected set of saws across the infeed direction.

3. The method of claim 2 including slewing the selected set of saws to cut along a path that includes a component that is at a nonzero angle relative to infeed direction.

4. The method of claim 1 in which cutting a cant includes dynamically skewing the saw arbor relative to the infeed direction and dynamically slewing the first set of saws along the length of the saw arbor across the path of the infeed direction to cut boards from a cant with lengthwise curvature or from a cant positioned at an angle to the infeed direction.

5. The method of claim 1 in which cutting a flitch includes setting the skew angle of the saw arbor relative to the infeed direction and dynamically slewing each of the second set of saws across the path of the infeed direction to cut boards from a flitch that is positioned at an angle to the infeed direction.

* * * * *